US010406825B2

(12) United States Patent
Skinner et al.

(10) Patent No.: US 10,406,825 B2
(45) Date of Patent: Sep. 10, 2019

(54) PIXEL CANVAS ART

(71) Applicant: CRAYOLA, LLC, Easton, PA (US)

(72) Inventors: Craig Skinner, Easton, PA (US); Luis Rodrigo Pineiro, Nazareth, PA (US)

(73) Assignee: Crayola LLC, Easton, PA (US)

( * ) Notice: Subject to any disclaimer, the term of this patent is extended or adjusted under 35 U.S.C. 154(b) by 0 days.

(21) Appl. No.: 15/951,993

(22) Filed: Apr. 12, 2018

(65) Prior Publication Data

US 2018/0304642 A1 Oct. 25, 2018

Related U.S. Application Data

(60) Provisional application No. 62/487,212, filed on Apr. 19, 2017.

(51) Int. Cl.

| | |
|---|---|
| ***B41J 2/485*** | (2006.01) |
| ***B44D 3/18*** | (2006.01) |
| ***B44C 1/28*** | (2006.01) |
| ***B41M 1/14*** | (2006.01) |
| ***B41M 1/12*** | (2006.01) |
| ***B41F 15/34*** | (2006.01) |
| ***B41F 15/36*** | (2006.01) |
| ***B41F 15/00*** | (2006.01) |
| ***B41L 13/00*** | (2006.01) |

(52) U.S. Cl.

CPC ..... *B41J 2/485* (2013.01); *B41F 15/00* (2013.01); *B41F 15/34* (2013.01); *B41F 15/36* (2013.01); *B41L 13/00* (2013.01); *B41M 1/12* (2013.01); *B41M 1/14* (2013.01); *B44C 1/28* (2013.01); *B44D 3/18* (2013.01)

(58) Field of Classification Search

CPC .. B41J 2/485; B41M 1/12; B41M 1/14; B41F 15/34; B41F 15/00; B41F 15/36; B41L 13/00; B44D 3/18; B44C 1/28

USPC ..... 347/110

See application file for complete search history.

(56) References Cited

U.S. PATENT DOCUMENTS 3,759,800 A * 9/1973 Reinke ..... B41C 1/14 101/127

5,662,040 A * 9/1997 Mori ..... B41C 1/144 101/116

* cited by examiner

*Primary Examiner* — Huan H Tran

*Assistant Examiner* — Alexander D Shenderov

(74) *Attorney, Agent, or Firm* — Shook Hardy & Bacon, LLP

(57) ABSTRACT

The present invention is directed towards an apparatus, a system and a method for creating a pixel canvas artwork. A pixel canvas art apparatus may contain a receiving layer that includes multiple segmented components, each of which may be enclosed by a fluid-resistant boundary. One or more water-based markings may be absorbed by the receiving layer at multiple segmented components and may be prevented from transferring throughout the receiving layer by the fluid-resistance boundaries. The one or more water-based markings may be absorbed at multiple segmented components in a manner that creates a pixel canvas artwork. Both a system for producing a pixel canvas artwork and a method for creating a pixel canvas artwork may include components similar to the pixel canvas art apparatus that may be used to create a pixel canvas artwork.

17 Claims, 10 Drawing Sheets

PIXEL CANVAS ART

CROSS-REFERENCE TO RELATED APPLICATIONS

This application, is a Non-Provisional Application which claims priority to U.S. Provisional Patent Application No. 62/487,212, entitled "PIXEL CANVAS ART," filed Apr. 19, 2017. The entirety of the aforementioned reference is hereby incorporated by reference.

SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section below. This summary is not intended to identify key features or essential features of the claimed subject matter, nor is it intended to be used as an aid in isolation to determine the scope of the claimed subject matter.

In brief and at a high level, this disclosure describes, among other things, an apparatus, system, and method for creating a pixel artwork on a canvas substrate, which may include multiple, pixelated components that visually contrast to collectively form a pixelated image. Embodiments of the invention include a color-receiving layer, such as a woven, knitted, or other textile material (e.g., a canvas material) for receiving markings of a water-based ink in context of surrounding ink-blocking treatment. For example, a canvas material may include multiple, pixelated components that visually form a pixelated image once individual pixels receive a desired colored marking that resides within the boundaries of each pixel (i.e., does not transfer across the surrounding ink-blocking treatment). The material may receive such ink-blocking treatment in a variety of ways, such as an embossed, ink-resistant treatment, a heated treatment, a screen-printed application, and the like. The color-receiving layer may therefore be provided with a pre-printed, pixelated structure that absorbs an amount of ink upon contact with an ink-dispensing device, such as a marker, in one embodiment of the invention.

In further aspects, the pixel canvas art apparatus may include a substrate having a pixelated surface treatment on at least a portion of the substrate, with multiple adjacent pixel elements surrounded by adjoining segments of ink-blocking barriers that reside in, on, and/or through the substrate. In one embodiment, the pixel canvas art apparatus includes a substrate and a receiving layer positioned atop the substrate. The substrate may have a top surface, a bottom surface opposite the top surface, and an interior body positioned there between. The receiving layer may have a first surface, a second surface opposite the first surface, and an internal body that may be positioned between the first and second surfaces. The pixel canvas art apparatus may further comprise a plurality of interconnected partitions that are positioned throughout the receiving layer, and a plurality of segmented components that are adjacently arranged within the receiving layer. The plurality of interconnected partitions may traverse the first and second surfaces, extend throughout the interior body, and may be configured to form a liquid-blocking barrier in at least a portion of the receiving layer. In some aspects, the plurality of interconnected partitions and the plurality of segmented components may also extend throughout at least a portion of the substrate. Further, the pluralities of interconnected partitions and segmented components may be formed in the receiving layer and the substrate by a pixelated surface treatment. Moreover, at least two or more interconnected partitions may form a border that encloses each segmented component of the plurality of segmented components, in one embodiment of the invention.

Other embodiments may be directed toward a system for producing a pixel canvas artwork including a pixel canvas that comprises a receiving layer, that receives and transfers fluid, with a plurality of interconnected fluid-resistant partitions, (i.e., canvas layer in a treated state), and a plurality of segmented components. (i.e., canvas layer in an untreated state). The receiving layer may be positioned atop a substrate and may have a first surface and a second surface, opposite the first surface, and may be configured to absorb a water-based marking, such as an ink marking from a water-based marker. Further, the plurality of interconnected fluid-resistant partitions may be positioned throughout the receiving layer and may be configured to prohibit transfer of the water-based marking absorbed by the receiving layer, such as prohibiting the transfer of a water-based marking in one pixel/segmented component to another pixel/segmented component of the receiving layer. In some embodiments, the plurality of segmented components may be adjacently arranged within the receiving layer and may be defined by at least two or more interconnected fluid-resistant partitions of the plurality interconnected fluid-resistant partitions. As such, in some aspects, the plurality of segmented components may be configured such that the water-based marking (e.g., ink from a first marker) absorbed by the receiving layer is enclosed by the plurality of interconnected fluid-resistant partitions such that an art image may be generated from the colorings applied to the various segmented components throughout the receiving layer. In this embodiment, the absorbed, water-based markings of each segmented component form a pixelated artwork image having markings interrupted by the interconnected, fluid-resistant partitions in an arranged configuration, such as a honeycomb or other repeated pattern throughout the receiving layer.

Embodiments of a method for creating a pixel canvas artwork may include steps for receiving multiple markings in association with multiple pixelated segments on a pixel canvas (e.g., receiving layer including a plurality of interconnected partitions and a plurality of segmented components) with the pixelated segments separated by fluid-resistant boundaries applied to the canvas layer. In some aspects, a first water-based marking and a second water-based marking may be applied on a first surface of a universal pixel canvas substrate. In some aspects, the universal pixel canvas may comprise a plurality of adjacently arranged pixel components, each of which comprises a position value based on a location of each adjacently arranged pixel component within the plurality of adjacently arranged pixel components. The method may further include receiving the first water-based marking in response to positioning a first application tip of a first marking device on the first surface of the universal pixel canvas at a first position value associated with a first pixel component. Similarly, the method may further include receiving, the second water-based marking in response to positioning a second application tip of a second marking device on the first surface of the universal pixel canvas at a second position value associated with a second pixel component. Additional aspects of the method may include a plurality of perimeters that may provide multiple fluid-resistant boundaries between two or more pixel components adjacently positioned within the plurality of adjacently arranged pixel components.

DESCRIPTION OF THE DRAWINGS

Illustrative embodiments of the invention are described in detail below with reference to the attached drawing figures, and wherein.

DETAILED DESCRIPTION

Figure 1A:
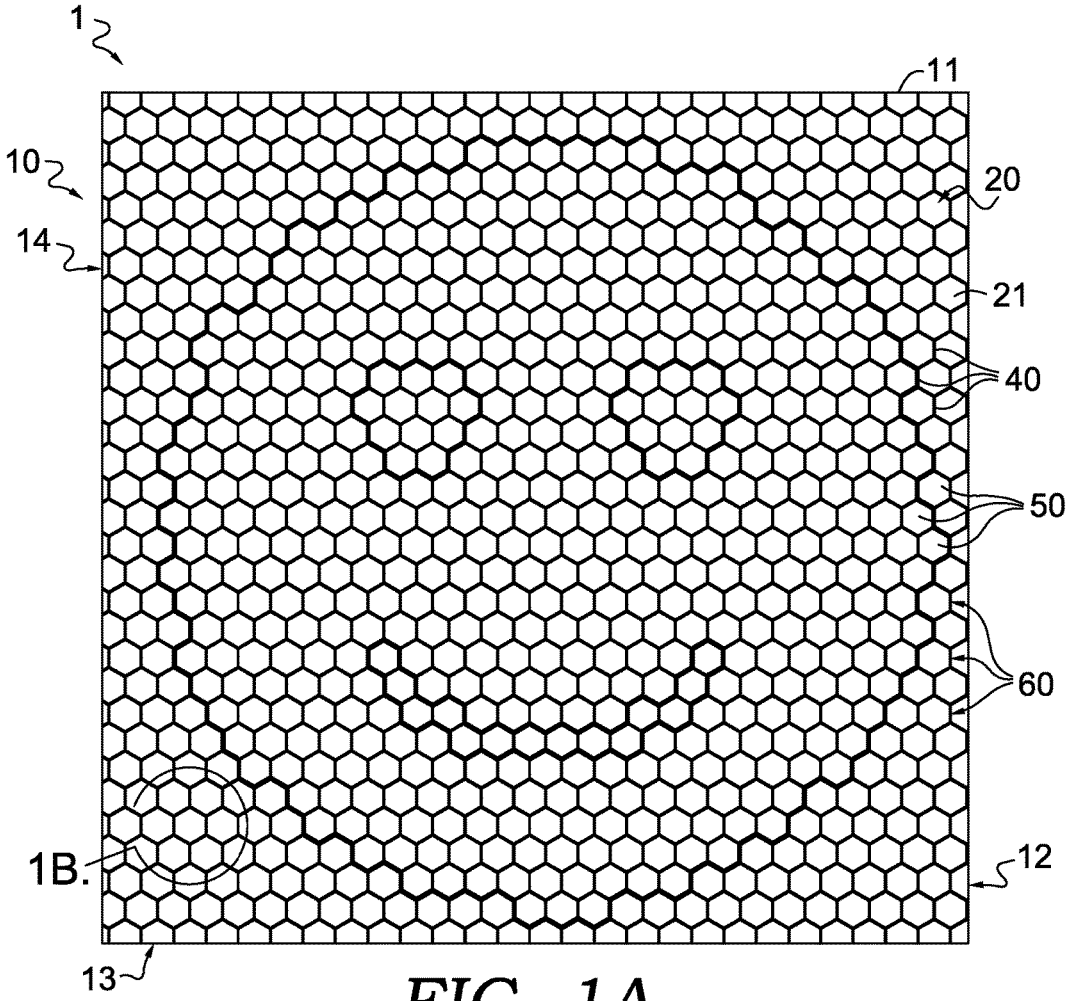
FIG. 1A is a top elevation view of a pixel canvas art apparatus, in accordance with an embodiment of the present invention.

The subject matter of embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Embodiments of the invention include, among other things, an apparatus, system, and method for creating a pixel canvas artwork. In an exemplary embodiment, the pixel canvas artwork may be created with a pixel canvas art apparatus having a receiving layer, a plurality of interconnected partitions, and a plurality of segmented components. In some embodiments, the pixel canvas art apparatus may further have a substrate, and the receiving layer may be positioned atop the substrate. Some aspects may relate to "pixels" formed in the receiving layer by the pluralities of interconnected partitions and segmented components. Moreover, aspects may include applying a water-based marking at an individual "pixel" that may be absorbed by the receiving layer. Such markings may be retained by the respective, recipient "pixel" upon absorbing the marking onto at least a portion of a first surface of the receiving layer. Embodiments also include a series of interconnected partitions that prevent the absorbed water-based marking from transferring to areas of the receiving layer that are not enclosed within the individual "pixel."

In such aspects, the plurality of interconnected partitions of the pixel canvas art apparatus may be positioned throughout the receiving layer such that each interconnected partition traverses a first surface and a second surface of the receiving layer, extends throughout an internal body of the receiving layer, and is configured to form a liquid barrier in the receiving layer. Further, the plurality of segmented components may be adjacently arranged within the receiving layer, and each segmented component may be enclosed by a border formed by at least two or more interconnected partitions. Accordingly, the border of each of segmented component may partition the receiving layer into individual "pixels" enclosed by a liquid barrier.

In additional aspects, the plurality of interconnected partitions and the plurality of segmented components may also be included in the at least a portion of the substrate may be configured in a manner like that of the receiving layer. Thus, the substrate may have a top surface, a bottom surface positioned opposite the top surface, and an internal body. Further, the plurality of interconnected partitions and the plurality of segmented components may be positioned in the substrate as described above (e.g., the plurality of interconnected partitions traversing the top surface and the bottom surface and extending throughout the internal body, and the plurality of segmented components being adjacently arranged within the substrate, each segmented component being enclosed by a border formed by at least two or more interconnected partitions), or the plurality of interconnected partitions and the plurality of segmented components may only be included in the substrate at the top surface and may be omitted from the internal body and the bottom surface. As such, the plurality of interconnected partitions of the pixel canvas art apparatus may be positioned throughout the receiving layer and the substrate such that each interconnected partition traverses the first and second surfaces of the receiving layer, extends throughout the internal body of the receiving layer, traverses the top surface of the substrate and is configured to form a liquid barrier in the receiving layer and at least a portion of the substrate.

Embodiments including the receiving layer and the substrate may include structural aspects, such as an arrangement, orientation, and relative sizing of the receiving layer and the substrate. In these embodiments, the receiving layer and the substrate may be positioned parallel and may be aligned along a same horizontal plane. The receiving layer may be positioned atop the substrate, with the second surface of the receiving layer being contiguous with the top surface of the substrate, and the receiving layer may be configured to fully extend overtop the substrate. In certain aspects, the receiving layer may be affixed to the substrate by an adhesive, which may be positioned on or between the second surface and the top surface. In further aspects, the receiving layer and the substrate may include corresponding dimensions causing their respective surfaces to be similar sizes. In some aspects, both the receiving layer and the substrate may have a similar thickness, or the substrate may have a greater thickness than the receiving layer. In exemplary aspects, the substrate may be configured to provide structural support for the receiving layer and may further be configured to aid in absorption and transfer prohibition of a water-based marking applied to the receiving layer.

In other embodiments, a pixelated surface treatment may be applied to the receiving layer and may be optionally applied to at least a portion of the substrate, such as the top surface, to form the pluralities of interconnected partitions and segmented components. Additionally, the top surface of the substrate that is treated with a pixelated surface treatment may be configured in a manner like that of the receiving layer, and therefore, some embodiments of the pixel canvas art apparatus may not require the receiving layer. In other embodiments, respective components of the receiving layer and the substrate may be optionally omitted to form multiple combinations having varying properties, which may be included in the pixel canvas art apparatus to meet certain manufacturing or operational needs.

Additional embodiments may be directed toward a system for producing a pixel canvas artwork including a pixel canvas that comprises a receiving layer, a plurality of interconnected fluid-resistant partitions, and a plurality of segmented components. In some aspects, the receiving layer may comprise a first surface and a second surface and may be configured to absorb a water-based marking. Further, the plurality of interconnected fluid-resistant partitions may be positioned throughout the receiving layer and may be configured to prohibit transfer of the absorbed water-based marking. The first surface of the receiving layer of the substrate may receive one or more surface treatments to generate one or more of the interconnected fluid-resistant partitions, such as a silk-screening procedure for applying a blocking medium, thereby generating partitions on and/or through the receiving layer. The plurality of segmented components may be adjacently arranged within the receiving layer and may be defined by at least two or more fluid-resistant partitions. Moreover, the plurality of segmented components may be configured to absorb the water-based marking and to separate the absorbed water-based marking from the other segmented components included in the plurality of segmented components.

Other embodiments may also include a method for creating a pixel canvas artwork involving receipt of one or more water-based markings on a first surface or a receiving layer of a universal pixel canvas. Exemplary aspects may relate to a plurality of adjacently arranged pixel components positioned within the universal pixel canvas, each of which comprise a position value based on a location of each pixel component within the plurality of adjacently arranged pixel components. The method may include the following steps: 1) receiving a first water-based marking on the first surface of the universal pixel canvas in response to positioning a first application tip of a first marking device on the first surface of the universal pixel canvas at a first position value associated with a first pixel component, and 2) receiving, a second water-based marking on the first surface of the universal pixel canvas in response to positioning a second application tip of a second marking device on the first surface of the universal pixel canvas at a second position value associated with a second pixel component. Additional aspects of the method may include a perimeter of the plurality of pixel components that provides a fluid-resistant boundary between each adjacently positioned pixel component.

As such, embodiments of the invention may contemplate using one or more marking devices to apply a water-based marking to a first surface of a receiving layer (e.g., a top surface of a substrate, a first surface of a universal pixel canvas) at a plurality of segmented components based on a position value associated with each segmented component. Aspects may include application of a first marking device to the first surface of the receiving layer based on a first position value of a specific segmented component, and upon application, the water-based marking may be transferred from a tip of the first marking device to the first surface of the receiving layer. The water-based marking may then be absorbed by a portion of the receiving layer included in the specific segmented component, and a liquid barrier enclosing the segmented component may prohibit transfer of the water-based marking throughout other portions of the receiving layer. In even further aspects, the same marking device or one or more additional marking devices may be used to transfer one or more additional water-based markings to the first surface of the receiving layer based on other position values of other specific segmented components. The one or more additional water-based markings may be transferred to the first surface of the receiving layer at designated position values associated with the plurality of segmented components until a pixelated image or pixel canvas artwork is created by the plurality of segmented components and the water-based markings absorbed therein.

Accordingly, a device for creating a pixel canvas artwork may include a pixel canvas art apparatus, and exemplary embodiments of the pixel canvas art apparatus are shown in FIGS. 1A-7. FIG. 1A shows a top elevation view of an exemplary pixel canvas art apparatus 1. As depicted, the pixel canvas art apparatus 1 may include an edge 10 formed by a first side 11, a second side 12, a third side 13, and a fourth side 14. The edge 10 may form an exterior perimeter of the pixel canvas art apparatus 1, which may define an overall size and shape of the pixel canvas apparatus 1. In the example of FIG. 1A, the first, second, third, and fourth sides 11, 12, 13, 14 are linear, have a same size, and from a square, and thus, the pixel canvas art apparatus 1 is also a square.

Although not depicted, in some aspects, the first, second, third, and fourth sides may each be straight or linear, and two opposing sides may be a same length. As such, the pixel canvas art apparatus may be a quadrilateral such as a rectangle. Other aspects may relate to specific lengths of the first, second, third, and fourth sides that are configured to provide a specific dimension to the pixel canvas art apparatus. For example, the first, second, third, and fourth sides may have lengths such that the pixel canvas art apparatus may have dimensions equal to a letter sized paper, or the first, second, third, and fourth sides may have varying lengths between. Thus, the pixel canvas art apparatus may include numerous dimensions, which may be modified in order to create a particular pixelated image or pixel canvas artwork. In exemplary aspects, the sides may be configured to have a ratio and dimensions of the sides having the ration may be sized such that a small, medium, and large of the pixel canvas art apparatus may be formed.

Additional aspects of the pixel canvas art apparatus may include an edge with a different shape or size than the example shown in FIG. 1A. Aspects may include a pixel canvas art apparatus with an edge or perimeter formed by straight or linear sides like in FIG. 1A but may include more or less sides. For example, the edge or the perimeter of the substrate may include three sides and may form a triangular shape or may include five sides and form a pentagonal shape. Further, each of the sides may be a same or a varying length. Other aspects may include one or more curvilinear sides that form an oval, a circle, or other rounded shape. Additionally, aspects may also include an edge formed by a combination of linear and curvilinear sides. Certain aspects may also include an edge that may be customizable and tailored to meet the needs of a particular pixelated image or a pixel canvas artwork.

In further aspects, the edge may be configured to be fluid resistant or impermeable. Such aspects may relate to using certain materials and techniques to form the edge and may also relate to treating the edge with a chemical compositions or curing methods. Essentially, the edge may be formed in a manner like that of the plurality of interconnected partitions and may include similar aspects and characteristics, as discussed herein.

Continuing with FIG. 1A, the pixel canvas apparatus 1 may further comprise, a receiving layer 20, a plurality of interconnected partitions 40, and a plurality of segmented components 50. The receiving layer 20 may include a first surface 21 at an uppermost side and may be positioned interiorly to the edge 10, which may define a perimeter of the receiving layer 20. Moreover, the receiving layer 20 may extend inwardly from the edge 10 to form a flat, horizontally positioned plane throughout an interior area defined by the edge 10. Although not shown, in exemplary aspects, the edge 10 may present a face that is aligned in a vertical direction, and thus, the receiving layer 20 may be oriented perpendicular to the face of the edge 10.

Figure 1B:
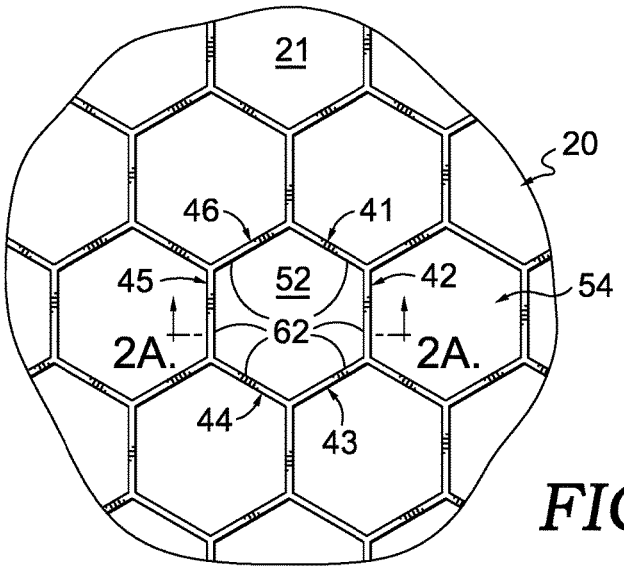
FIG. 1B is an enlarged, top elevation view of a portion of the pixel canvas art apparatus of FIG. 1A, taken in the area 1B, in accordance with an embodiment of the present invention.

In additional aspects, the pixel canvas art apparatus 1 may further comprise a substrate configured to provide structural support and aid in the absorption of water-based markings. With additional reference to FIG. 2A, a cross section view taken along the line 2A of FIG. 1B depicts an exemplary configuration of the receiving layer 20 and the substrate 30 in the pixel canvas apparatus 1. As, shown, the substrate 30 may be positioned immediately below the receiving layer 20, and in exemplary aspects, the receiving layer 20 may be configured to fully extend overtop the substrate 30, and therefore, when viewing the pixel canvas art apparatus 1 from above, the receiving layer 20 is visible, while the substrate 30 is hidden from view. The receiving layer 20 and the substrate 30 may be included in the pixel canvas apparatus 1 as a same shape with equal dimensions and surface area, and the receiving layer 20 and the substrate 30 may be uniformly aligned and share a same perimeter. As such, the edge 10 may also define a perimeter of the substrate 30, and the substrate 30 may extend inwardly from the edge 10 to form a flat, horizontally positioned plane throughout an interior area defined by the edge 10. Thus, the receiving layer 20 and the substrate 30 may form an equal, horizontal portion of the pixel canvas art apparatus 1 and further, may collectively form an overall structure of the pixel canvas apparatus 1. The receiving layer 20 and the substrate 30 may be co-planar and may maintain a parallel position with one another throughout the pixel canvas art apparatus 1.

Although not depicted, in other aspects, the receiving layer and the substrate may be different shapes, have different dimensions, or both and may be included in the pixel canvas art apparatus in a non-uniform manner. For example, both the receiving layer and the substrate may have a square shape, but the receiving layer may be smaller and have less surface area than the substrate. As such, the receiving layer may only extend overtop a portion of the substrate leaving another portion of the substrate exposed, and from a top view, an exposed portion of the substrate would be visible. Moreover, it is contemplated that the receiving layer and the substrate may each be included in the pixel canvas art apparatus as a shape of any suitable size with three or more linear sides, curvilinear sides, or both, which may include a triangle, quadrilateral, pentagon, hexagon, circle, oval, and the like. It is further contemplated that a size and shape of the receiving layer and the substrate may be customizable and tailored to meet the needs of a particular pixelated image or a pixel canvas artwork.

Figure 2A:
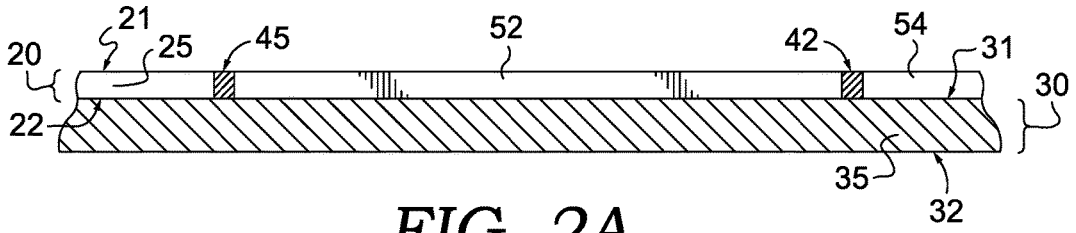
FIG. 2A depicts a cross section view of a the pixel canvas art apparatus of FIG. 1A, taken along the plane 2A of FIG. 1B, in accordance with an embodiment of the present invention.
Figure 2B:
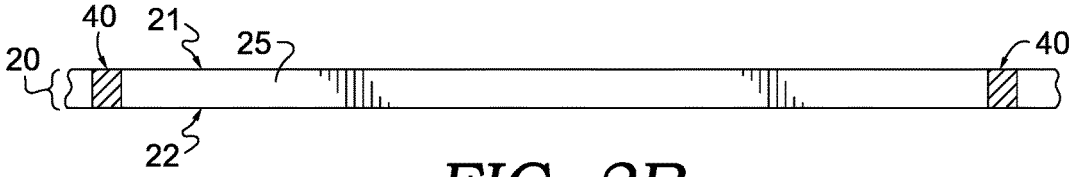
FIG. 2B depicts a cross section view of a receiving layer of the pixel canvas art apparatus of FIG. 2A, in accordance with an embodiment of the present invention.
Figure 2C:
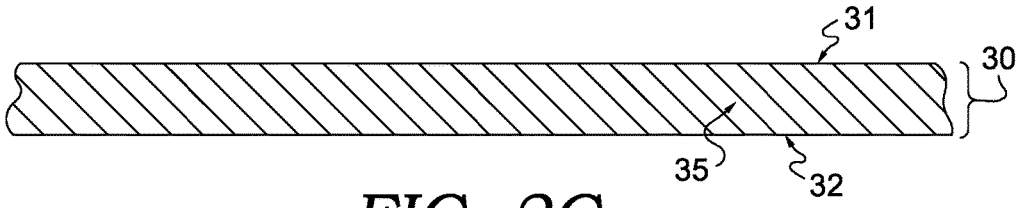
FIG. 2C depicts a cross section view of a substrate of the pixel canvas art apparatus of FIG. 2A, in accordance with an embodiment of the present invention.

Continuing with FIG. 2A and with reference to FIGS. 2B and 2C, which respectively show a cross section view the receiving layer 20 and the substrate 30 as individual components. As shown, the receiving layer 20 and the substrate 30 may be joined with one another along a respective surface. The receiving layer 20 comprises the first surface 21, a second surface 22, and an interior body 25 that may be planar, include a thickness, and form an overall structure of the receiving layer 20. Similarly, the substrate 30 may comprise a top surface 31, a bottom surface 32, and an internal body 35 that may be planer, include a thickness which may or may not be greater than the receiving layer 20, and form an overall structure of the substrate 30. As best shown in FIG. 2A, when positioned in the pixel canvas art apparatus 1, the second surface 22 of the receiving layer 20 may be contiguous with the top surface 31 of the substrate 30, forming an area of contact between the two. In exemplary aspects, the receiving layer 20 and the substrate 30 are attached to one another at the second surface 22 and the top surface 31 by an adhesive, which may be applied to either surface or both. In such aspects, the receiving layer 20 may be mounted onto the substrate 30 using an adhesive and the substrate 30 may be configured to act as backing board for the receiving layer 20.

An adhesive may be configured to be compatible with water such that retention properties of the adhesive are not diminished when the adhesive is wetted. Moreover, the adhesive may be configured to attach the receiving layer 20 and the substrate 30 such that the receiving layer 20 may be smooth and flat throughout, without wrinkles. Further, the adhesive may be non-toxic and safe for use by children, and therefore, the adhesive may meet the standards of the Art and Creative Materials Institute (ACMI). Suitable commercially available adhesives are known in the art, but may include laminate glue or other evenly applied glue material that joins the adhesive and substrate into consistent contact, without impacting the fluid transfer properties of the receiving layer 20.

In exemplary aspects, the receiving layer 20 and the substrate 30 may be configured to have various properties, which may be accomplished by constructing the receiving layer 20 and the substrate 30 from certain materials or by treating the receiving layer 20 and the substrate 30 with coatings, finishes, chemicals, and the like. In some aspects, all or part of the receiving layer 20 and the substrate 30 may be formed of a material or may be treated to impute certain properties to all or a specific portion of the receiving layer 20 and the substrate 30.

With respect to the receiving layer 20, a material configured to promote transfer of a water-based marking from an application device that is also capable of absorbing the water-based marking may be used to construct the receiving layer 20. In some aspects, the receiving layer 20 may be comprised of a paper canvas, silkscreen canvas, specialty fabric, polyester, and the like. In exemplary aspects, the receiving layer 20 may be constructed from china silk or synthetic polyester. Other aspects may include forming all or part of the receiving layer 20 from a material with wicking properties that may include a hydrophilic material or a material that promotes absorption of water-based markings. As such, the first surface 21, the second surface 22, and the interior body 25 may all be formed of the same material and may exhibit similar features. In other aspects, the first and second surfaces 21, 22 may optionally include a coating that imputes various properties to the receiving layer 20. For instance, the first and second surfaces 21, 22 may comprise a coating that is hydrophilic and promotes absorption of a water-based marking, or the second surface 22 may comprise a coating that is hydrophobic and prevents transfer of a water-based marking such as durable water repellants.

Regarding the substrate 30, a material configured to be rigid and semi-absorbent may be used to construct the substrate 30. In exemplary aspects, the substrate 30 may be configured to provide a framework, support structure, stabilizing surface, or any combination thereof for the receiving layer 20. In some aspects, the substrate 30 may be configured to promote absorption of a water-based marking in the receiving layer 20. In such aspects, the substrate 30 may wick a water-based marking applied to the first surface 21 of the receiving layer 20 toward the substrate 30. Thus, the substrate 30 may draw a water-based marking received from a marking device at the first surface 21 through the receiving layer 20 toward the substrate 30 and therefore, may promote a unidirectional flow of a water-based marking through the receiving layer 20. In other aspects, the substrate 30 may be configured to be moisture resistant.

In some aspects the substrate 30 may be comprised of a cardboard, paperboard, poster board and the like and may optionally include a coating that may either promote absorption or resist moisture. Additional aspects may include forming all or part of the substrate from a material configured to be rigid and semi-absorbent. Thus, the top surface 31, the bottom surface 32, and the internal body 35 may all be formed of a same material and have the same properties and features. Other aspects may include optionally treating the top and bottom surfaces 31, 32 with a coating or chemical that affords certain properties to the substrate 30. For example, the top surface 31 may comprise a coating that is hydrophilic and promotes semi-absorption of a water-based marking by the substrate 30, and the bottom surface 32 may include a coating that is hydrophobic or prevents transfer of a water-based marking such as durable water repellants.

In exemplary aspects, the receiving layer 20 is configured to include multiple, pixelated components formed by fluid-resistant barriers positioned throughout the receiving layer 20. As such, the interconnected partitions 40 may be positioned throughout the receiving layer 20 and may be configured to form fluid-resistant barriers therein. Thus, the interconnected partitions 40 may extend throughout a thickness of the receiving layer 20 in a manner sufficient to prohibit transfer of a water-based marking from one segmented component to any other segmented component. In the example of FIG. 2B, the interconnected partitions 40 may traverse the first and second surfaces 21, 22 and extend through the interior body 25. Thus, the interconnected partitions 40 form physical barriers within the receiving layer 20 that define the segmented components 50. In further aspects, the interconnected partitions 40 may extend entirely throughout the receiving layer or may only extend throughout a portion of the receiving layer 20 that is configured to absorb a water-based marking. Moreover, a manner in which the interconnected partitions 40 are positioned within the receiving layer 20 may depend on a configuration of the receiving layer 20 and the pixel canvas art apparatus 1.

As shown in FIG. 2A, the interconnected partitions 40 terminate proximate the second surface 22 of the receiving layer 20 and are not included in the substrate 30. Although not depicted, it is contemplated herein that the interconnected partitions 40 may be included in a portion of or throughout the substrate 30. It is further contemplated that the interconnected partitions 40 may only traverse the top surface 31 of the substrate 30, may traverse the top surface 31 and extend into a portion or all of the internal body 35, or may traverse the top and bottom surfaces 31, 32 and extend throughout the internal body 35.

As discussed herein, the interconnected partitions 40 may be configured to form a liquid barrier in the pixel canvas art apparatus 1. This exemplary aspect may be contributed to a manner in which the interconnected partitions 40 are formed in the receiving layer 20. Such aspects may relate to a placement and orientation of the interconnected partitions 40 throughout the receiving layer 20, a material or composition that is used to construct the interconnected partitions 40, and a process or technique that is used to form the interconnected partitions 40. As such, the interconnected partitions 40 may include various aspects, properties, and characteristics that configure the interconnected partitions 40 to form liquid or fluid resistant barriers in the receiving layer 20.

In some aspects, The interconnected partitions 40 may be configured to section the receiving layer 20 into multiple, separated components. As such, the interconnected partitions 40 may be positioned vertically throughout the receiving layer 20, and further, the interconnected partitions 40 may maintain a parallel orientation with one another. Stated differently, the interconnected partitions 40 may be aligned in a vertical direction or a direction that is perpendicular to the horizontal alignment of the receiving layer 20. In more aspects, the interconnected partitions 40 may extend throughout an entirety of the receiving layer 20 and terminate proximate the first and second surfaces 21, 22. Thus, the interconnected partitions 40 and the first and second surfaces 21, 22 may form a flat, continuous exterior about the receiving layer 20 along an uppermost side that presents the first surface 21 and an opposing side that presents the second surface 22. Accordingly, the uppermost side and the opposing side of the receiving layer 20 may include integrated portions of the interconnected partitions 40.

In other aspects, the interconnected partitions 40 may extend between the first and second surfaces 21, 22 and throughout the interior body 25 of the receiving layer 20. Therefore, the first surface 21 may partially or fully overlay the interconnected partitions 40, and the second surface 22 may partially or fully overlay the interconnected 40. In even more aspects, the interconnected partitions 40 may extend throughout an entirety of the receiving layer 20 and may further extend beyond the first surface 22, the second surface 22, or both. Thus, the interconnected partitions 40 may protrude and interrupt the first surface 21 and the second surface 22.

In exemplary aspects, the interconnected partitions 40 may be configured to be fluid resistant or impermeable. Such aspects may relate to using certain materials and techniques to form the interconnected partitions 40 throughout the receiving layer 20 and may also relate to treating the interconnected partitions 40 with chemical compositions or curing methods. In these aspects, the interconnected partitions 40 may comprise a fluid-resistant material, which may include specialty inks and may be formed throughout the receiving layer 20 by traditional screen printing methods.

In one aspect, the interconnected partitions 40 may comprise an ink capable of forming an impermeable barrier throughout the receiving layer 20. The ink may be an ultraviolet (UV) ink and may be printed onto the first surface 21 of the receiving layer 20 using known printing methods including, but not limited to, screen printing, direct to garment printing, sublimation, and the like. The ink may be printed such that the ink may be positioned and structured within in the receiving layer 20 to form a configuration of the interconnected partitions 40 as described herein. Thus, the ink may be printed onto the receiving layer 20 such that the ink traverses the first surface 21, disperses throughout the interior body 25, and traverses the second surface 22. Additionally, the ink may be printed on the first surface 21 in a manner that forms a pattern like those discussed in connection with the interconnected partitions 40 such as the "honeycomb" configuration. As such, after printing the first surface 21, the ink may form the interconnected partitions 40 throughout the receiving layer 20.

In other aspects, the ink may or may not be cured subsequent to printing, which may depend on a type of ink that is used. For instance, the ink may be UV cured to cause photochemical reactions that impart structural changes to the ink, which enhance or promote fluid-resistant properties and/or cause the ink to be impermeable. One aspect includes use of a UV ink and a UV curing process. Moreover, the UV curing process may cause the UV ink to undergo chemical reactions such as crosslinking, which alter certain properties of the UV ink by causing resins in the UV ink to harden. Other aspects may also include non-UV inks that may have similarly altered properties after undergoing post-printing treatment methods. In additional aspects, the interconnected partitions 40 may comprise a dye blocker, an ink blocker, or the like, which further aids the interconnected partitions 40 from preventing transfer of a water-based marking absorbed by the receiving layer 20.

In additional aspects, which are illustrated in FIGS. 1A-5A and 6A-7, the interconnected partitions 40 may extend throughout the receiving layer 20 in multiple directions along a horizontal plane and may be continually joined in a manner such that the interconnected partitions 40 form the plurality of borders 60 throughout the receiving layer 20, which in turn, define the segmented components 50. The interconnected partitions 40 may be uniformly sized and shaped, and thus, the interconnected partitions 40 may be arranged throughout the receiving layer 20 to form a tessellating pattern with rows and columns of repeating shapes. Further, the rows may extend between the second side 12 and the fourth side 14 of the pixel canvas apparatus 1, and the columns may extend between the first side 11 and the third side 13 of the pixel canvas apparatus 1. Moreover, repeating shapes of a row or column may be linearly aligned, and the rows and columns may be orientated in a perpendicular manner. In addition, each row may be positioned in the receiving layer 20 such that each row maintains a same distance from the first side 11 or the third side 13, and similarly, each column may be positioned in the receiving layer 20 such that each column maintains a same distance from the second side 12 or the fourth side 14. As such, each shape included in a same row may be positioned in the receiving layer 20 at a same distance from the first side 11 or the third side 13, and each shape included in a same column may be positioned in the receiving layer 20 at a same distance from the second side 12 or the fourth side 14.

In further aspects, the interconnected partitions 40 may be linear or straight and may angularly join with one another throughout the receiving layer 20. Moreover, the interconnected partitions 40 may be a same size and may be joined in a manner to form a shape. As such, the interconnected partitions 40 may form multiple rows and columns of shapes throughout the receiving layer 20. In some aspects, the interconnected partitions 40 may be configured to form a "honeycomb" pattern. As such, the interconnected partitions 40 form hexagons having a same size that are aligned in rows and columns throughout the receiving layer 20, which collectively may form a hexagonal matrix. In other aspects, although not depicted, the interconnected partitions 40 may be configured to form a pattern of repeating squares that are linearly aligned in rows and columns throughout the receiving layer 20. In even other aspects, the interconnected partitions 40 may be positioned throughout the receiving layer 20 in a non-uniform manner or in a manner that best suits a particular pixelated image or a pixel canvas artwork.

As discussed herein and illustrated in FIG. 1A, the interconnected partitions 40 as-a-whole may define a plurality of borders 60 that enclose the segmented components 50 throughout the receiving layer 20. Thus, a configuration of the segmented components 50 in the pixel canvas art apparatus 1 may be based on a configuration of the interconnected partitions 40 in the receiving layer 20. As such, the segmented components 50 may be integrated throughout the receiving layer 20 in a manner that corresponds to a configuration of the interconnected partitions 40 and may form multiple, individual pixel components at portions of the receiving layer 20 that are sectioned in a manner that also corresponds to a configuration of the interconnected partitions 40.

In exemplary aspects, which are illustrated in FIGS. 1A and 2A, the segmented components 50 may be adjacently arranged throughout the receiving layer 20 and may be enclosed within the borders 60. Thus, the segmented components 50 include discrete portions of the receiving layer 20 that are positioned within the borders 60 and are separated from one another throughout the receiving layer 20. As such, the segmented pixel components 50 may include characteristics, features, and properties of the receiving layer 20 and be formed from a same material. Therefore, the segmented components 50 may be configured to promote transfer of a water-based marking from an application device and may be configured to absorb a water-based marking.

Further, the segmented components 50 may have an overall shape and size that may be defined by the borders 60. As the borders 60 may be formed by the interconnected partitions 40, a shape and size of the segmented components 50, may be associated with a configuration of the interconnected partitions 40 in the receiving layer 20. Therefore, the segmented components 50 may include linear sides when the interconnected partitions 40 are positioned in the receiving layer 20 in a linear manner, and the segmented components 50 may include curvilinear sides when the interconnected partitions are positioned in the receiving layer 20 in a curvilinear manner.

In further aspects, the segmented components 50 may be arranged within the receiving layer 20 in rows and columns that may correspond to the rows and columns formed by the interconnected partitions 40. As such, the segmented components 50 may form a tessellating pattern with rows and columns of repeating shapes, which may include shapes. Further, each repeating shape of a row or column may be linearly aligned, the rows and columns may be orientated and positioned in the receiving layer in a manner to correspond to the rows and columns formed by the plurality of interconnected partitions. As such, the segmented components 50 that form a shape included in a same row may be positioned in the receiving layer 20 at a same distance from the first side 11 or the third side 13, and the segmented components 50 that form a shape included in a same column may be positioned in the receiving layer 20 at a same distance from the second side 12 or the fourth side 14. In exemplary aspects, the segmented components 50 may be equally sized hexagons that are linearly aligned in rows and columns to form a "honeycomb" pattern or a hexagonal matrix. In other aspects, the segmented components 50 may be configured to be equally sized squares that are linearly aligned in rows and columns and form a pattern of repeating squares. In even other aspects, segmented components 50 may from non-uniform shapes or shapes that best suit a particular pixelated image or a pixel canvas artwork.

In even further aspects, a single segmented component may be enclosed by one border that may be formed by a group of interconnected partitions that includes two or more, continuously joined interconnected partitions. Each of the interconnected partitions included in the group is continuously joined such that an interior side of each interconnected partition forms a portion of a corresponding border. Thus, each interconnected partition of the group may be joined with two other interconnected partitions of the group to collectively create the border, which may be defined by the interior sides the group of interconnected partitions. The border may enclose and define the single segmented component, which may be referred to as a pixel component. Thus, the group of interconnected partitions may form the border, and the border may define the pixel component, which may be positioned interior to the group on interconnected partitions.

In FIGS. 1B and 2A, exemplary aspects of related to a pixel component, a border, and a group of interconnected partitions are illustrated. FIG. 1B is an enlarged portion of the pixel canvas art apparatus 1 at an area 1B of FIG. 1A, and FIG. 2A is a cross section of the pixel canvas art apparatus 1 taken along the line 2A in FIG. 1B. In this example, a pixel component 52 may be enclosed within a border 62 formed by a group of interconnected partitions including a first interconnected partition 41, a second interconnected partition 42, a third, interconnected partition 43, a fourth interconnected partition 44, a fifth interconnected partition 45, and a sixth interconnected partition 46. As shown, the first, second, third, fourth, fifth, and sixth 41, 42, 43, 44, 45, 46 are continuously joined to one another such that each interconnected partition is joined with two other interconnected partitions at opposing ends. For example, the first interconnected partition 41 joins with the sixth and second interconnected partitions 46, 42 at opposing ends, the second interconnected partition 42 joins with the first and third interconnected partitions 41, 43 at opposing ends, the third interconnected partition 43 joins with the second and fourth interconnected partitions 42, 44 at opposing ends, and so on. Thus, the interior sides of the group of interconnected partition collectively form an uninterrupted, boundary, or the border 62, around a single segmented component, or the pixel component 52. As such, the group of interconnected partitions form a hexagon, and thus, the border 62 is a hexagon, which defines a hexagonal shape of the pixel component 52.

In other aspects, two adjacently positioned segmented components may be separated by a same interconnected partition. As shown in FIGS. 1B and 2A, the pixel component 52 may be separated by an adjacent pixel component 54 by a same interconnected partition, or the second interconnected partition 42, and therefore, the pixel component 52 and the adjacent pixel component 54 are positioned on opposing sides of the second interconnected partition 42. Stated another way, the pixel component 52 and the adjacent pixel component 54 are enclosed by a same portion of the border 62 formed by the second interconnected partition 42. In further aspects, two adjacently positioned segmented components may be separated in this same manner throughout the receiving layer 20.

Figure 3A:
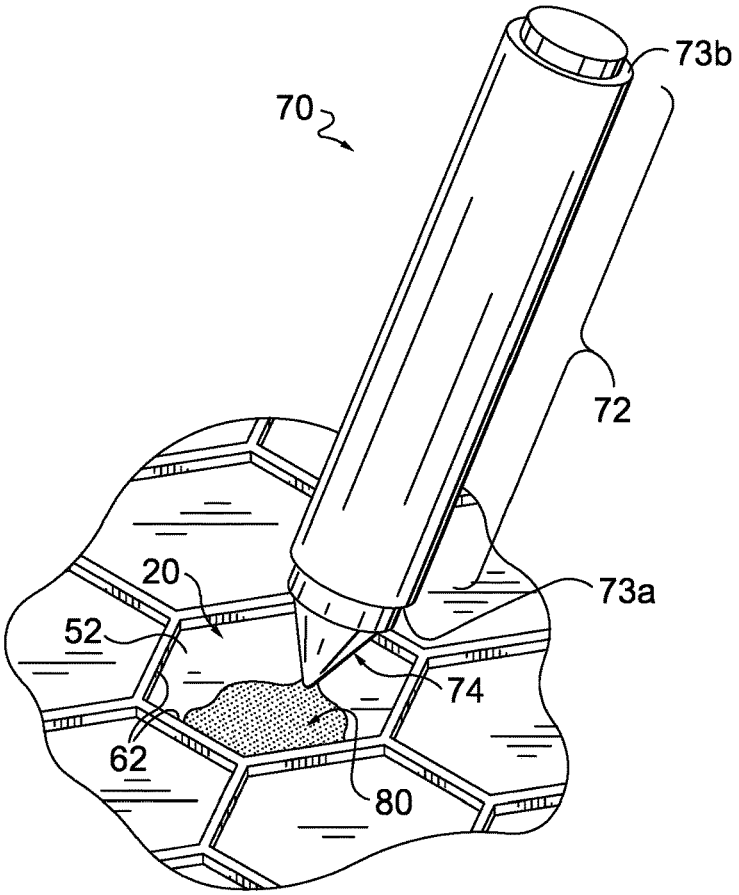
FIG. 3A depicts an enlarged, fragmentary, perspective view of the pixel canvas art apparatus of FIG. 1A with a portion removed, illustrating transfer of a water-based marking from a marking device to a substrate, in accordance with an embodiment of the present invention.
Figure 3B:
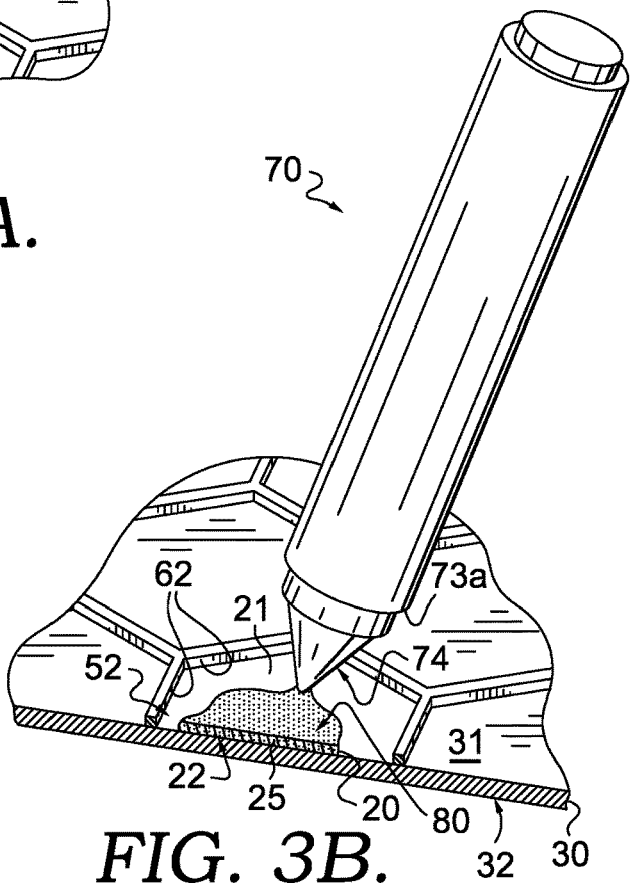
FIG. 3B depicts an enlarged, fragmentary, perspective view of the pixel canvas art apparatus of shown in FIG. 1A with multiple portions removed, illustrating transfer of a water-based marking at an interior portion of the receiving layer, in accordance with an embodiment of the present invention.

In accordance with exemplary aspects, the pixel canvas art apparatus 1 may be configured to create a pixel canvas artwork. As discussed herein, the pixel canvas art apparatus 1 may receive multiple water-based markings at the segmented components 50, which collectively create a pixelated image or pixel canvas artwork. Turning now to FIGS. 3A-3B, which are perspective views of a portion of the pixel canvas apparatus 1 showing application and absorption of a water-based marking, exemplary aspects of the application and absorption of a water-based marking are illustrated. As shown, a marking device 70 may be configured to transfer a water-based marking 80 from the marking device 70 to the first surface 21 of the receiving layer 20. Generally, the marking device 70 may comprise a body 72 and an application tip 74. The body 72 may extend between a first end 73*a* and a second end 73*b* to form a cylinder, which may be hollow and define an interior body chamber. The application tip 74 may extend outwardly from the first end 73*a* of the body 72 and may conically taper to form a distal tip. In additional aspects, a nib may be encased within the interior body chamber and may be configured to store, retain, and/or control release of the water-based marking 80. Moreover, the application tip 74 may be joined with the nib proximate the first end 73*a*. Further, the application tip 74 may be configured to receive the water-based-marking 80 from the nib, and upon contacting an object or surface, the application tip 74 may be configured to transfer the water-based marking 80 onto a contacted object or surface.

In some aspects, the marking device 70 may be a variety of markers commercially offered by Crayola® LLC of Easton, Pa. such as broad line markers, fine line markers, washable markers, and permanent markers, which may include Ultra-Clean Washable Markers, Tri-Color Markers, SuperTips Washable Markers, Regular, Pip-Squeaks® Markers, Crystal Effects Markers, and Window and Bright Fabric Markers. Moreover, the marking device 70 may also be commonly available pens or other writing utensils including but not limited, ink pens, ballpoint pins, magic markers, airbrush markers, and the like. In other aspects, the application tip 74 may be configured to efficiently transfer the water-based marking 80 from the nib to the segmented components 50. As such, the application tip 74 may be of a size that allows for a user to easily place the application tip 74 within each of the segmented components 50 without contacting any adjacent segmented component, and further, the application tip 74 may transfer an amount of water-based marking 80 that will not overflow to or encroach upon any adjacent segmented components. These aspects are discussed in greater detail herein.

Figure 4A:
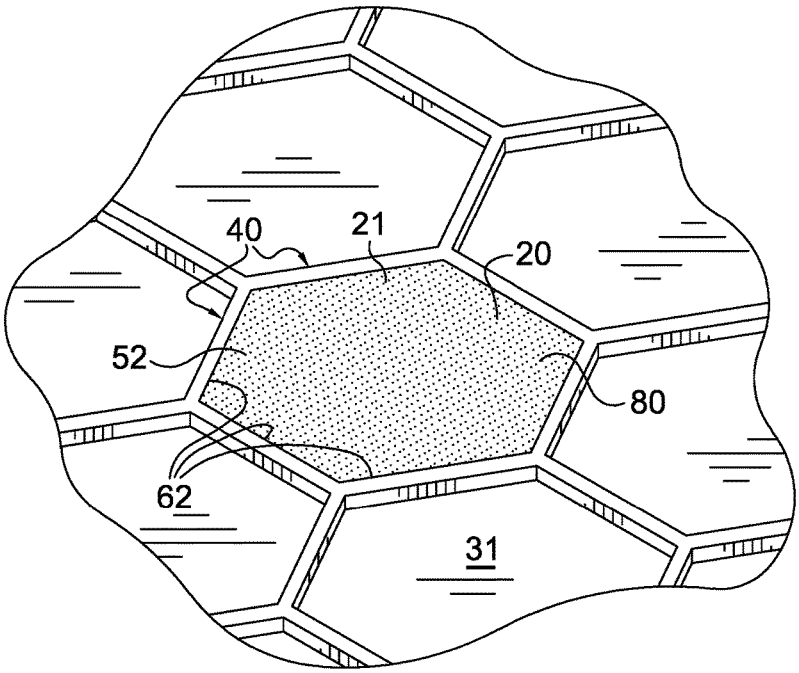
FIG. 4A depicts an enlarged, fragmentary, perspective view of the pixel canvas art apparatus of FIG. 1A with a portion removed, illustrating absorption of a water-based marking by a receiving layer after the water-based marking has been transferred from a marking device, in accordance with an embodiment of the present invention.
Figure 4B:
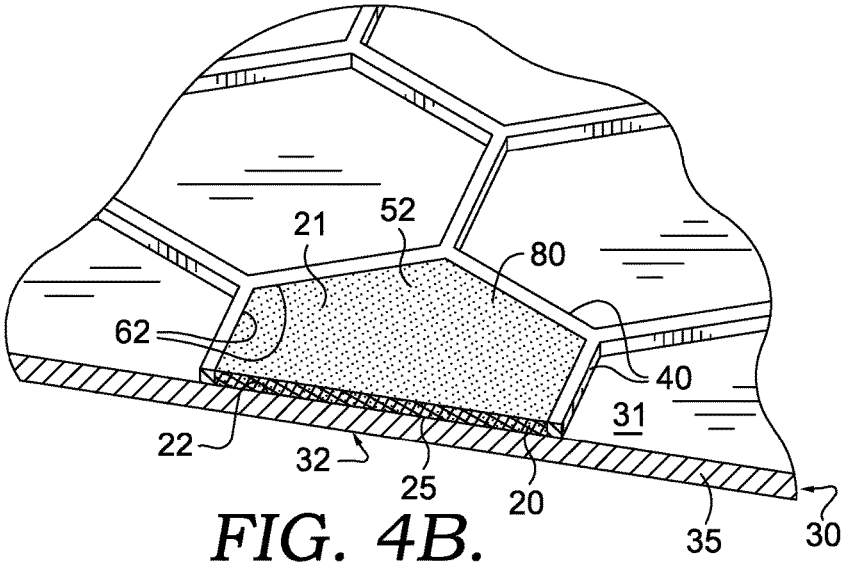
FIG. 4B depicts an enlarged, fragmentary, perspective view of the pixel canvas art apparatus of FIG. 1A with multiple portions removed, illustrating absorption of a water-based marking at an interior portion of the receiving layer, in accordance with an embodiment of the present invention.

Staying with FIGS. 3A-3B and with additional reference to FIGS. 4A-4B, upon contact between the first surface 21 and the application tip 74, the water-based marking 80 may be transferred to the receiving layer 20, which may be configured to absorb the water-based marking 80. As depicted in FIGS. 3A-3B, the marking device 70 may be applied to the receiving layer 20 to transfer the water-based marking 80 from the application tip 74 once the first surface 21 is contacted. Moreover, the marking device 70 may be applied to the receiving layer 20 at one or more points of contact included within an area enclosed by the border 62 of the pixel component 52. As such, the water-based marking 80 transferred from the marking device 70 may be wicked by the receiving layer 20 and absorbed throughout the interior body 25. Further, an amount of water-based marking 80 absorbed by the receiving layer 20 may be related to an amount of time in which contact between the application tip 74 and the first surface 21 is maintained. In some aspects, as duration of contact between the application tip 74 and the first surface 21 increases, more of the water-based marking 80 may be transferred from the marking device 70, which may be absorbed throughout a greater portion of the receiving layer 20.

As best shown in FIGS. 4A-4B, after applying the marking device 70 in a manner such that contact between the application tip 74 and the first surface 21 may be maintained for a sufficient duration, the water-based marking 80 may be completely absorbed throughout the receiving layer 20. Thus, the water-based marking 80 may be entirely dispersed throughout the first surface 21, throughout the second surface 22, and within the interior body 25. Further, the water-based marking 80 absorbed by the receiving layer 20 may be enclosed within the pixel component 52, and any further transfer of the water-based marking 80 may be prevented by the border 62 enclosing the segmented component 52. In some aspects, a sufficient duration of contact between the application tip 74 and the first surface 21 may be less than one second, and additionally, an excessive amount of water-based marking 80 transferred to the pixel component 52 may be exit the receiving layer 20 at the second surface 22 and be absorbed by the substrate 30. In other aspects, the application tip 74 and the first surface 21 may maintain contact for a threshold amount of time that may be an amount of time required for the water-based marking 80 to be dispersed and absorbed throughout a portion of the receiving layer 20 included in one of the segmented components 50. In such aspects, if the application tip 74 and the first surface 21 maintain contact for an amount of time that is less than the threshold amount of time, the water-based marking 80 will not be fully dispersed or fully absorbed throughout a portion of the a portion of the receiving layer 20 included in one of the segmented components 50. Conversely, when the application tip 74 and the first surface 21 maintain contact for an amount of time that is greater than the threshold amount of time, an excess of the water-based marking 80 will be transferred to a portion of the receiving layer 20 included in one of the segmented components 50. The excess water-based marking 80 may still be absorbed by the receiving layer 20 or may be transferred from the receiving layer 20 to the substrate 30 at the second surface 22 and the top surface 31. In other aspects, the marking device 70, the receiving layer 20, or both may be configured to prevent transfer of an excess of the water-based marking 80 from the application tip 74 and the first surface 21. In such aspects, the application tip 74 may be configured to transfer the water-based marking 80 through aspects of microfluidics, and the receiving layer 20 may be configured to absorb the water-based 80 through aspects of microfluidics. The water-based marking 80 may be transferred from the application tip 74 to the first surface 21 such that an excess of the water-based marking 80 may not be transferred.

In certain aspects, the water-based marking 80 may or may not be absorbed by the receiving layer 20 at the second surface 22 or a portion of the substrate 30 depending on a coating that may be optionally included in the second surface 22 or a portion of the substrate 30. As discussed herein, the second surface 22 or the substrate 30 may comprise a coating that is hydrophobic or prevents transfer of a water-based liquid such as durable water repellants that may cause the second surface 22 or the substrate 30 to be impermeable. When such a coating is included in the second surface 22 or the substrate 30, the water-based marking 80 may be absorbed in the receiving layer 20 throughout the first surface 21 and interior body 25 but may not be absorbed at the second surface 22. Thus, the second surface 22 may act as an additional liquid barrier like the interconnected partitions 40 and the borders 60. As such, the second surface 22 or part of the substrate 30 may also enclose the water-based marking 80 absorbed by the receiving layer 20 within the pixel component 52, and may also prevent the water-based marking 80 from transferring or exiting the receiving layer 20 at the second surface 22.

In some aspects, the water-based marking 80 included in the marking device 70 may be associated with a color. Upon transfer of the water-based marking 80 to the receiving layer 20, the water-based marking 80 may be absorbed by the receiving layer 20 and may be configured to impart a color onto the receiving layer 20. Thus and in further aspects, the marking device 70 may include the water-based marking 80 that may be associated with a particular color. Further, additional marking devices may include more water-based markings associated with other colors, and additional marking devices may be implemented to impart multiple colors onto the receiving layer 20. In some aspects, the water-based marking 80 may be any color and may be any solution for marking on a surface including, but not limited to, a washable ink solution, a non-washable ink solution, a permanent ink solution, a color-changing ink solution, an invisible-ink solution, and/or any other marker ink solution.

Figure 5A:
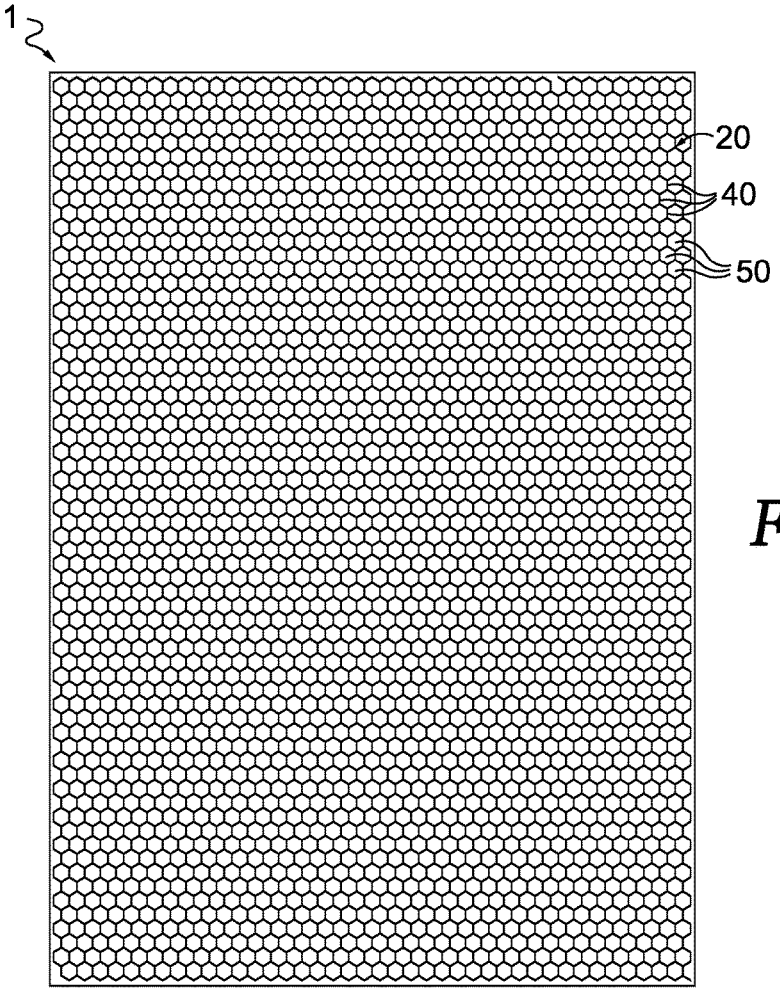
FIG. 5A is a top elevation view of an embodiment of the pixel canvas art apparatus, in accordance with an embodiment of the present invention.
Figure 5B:
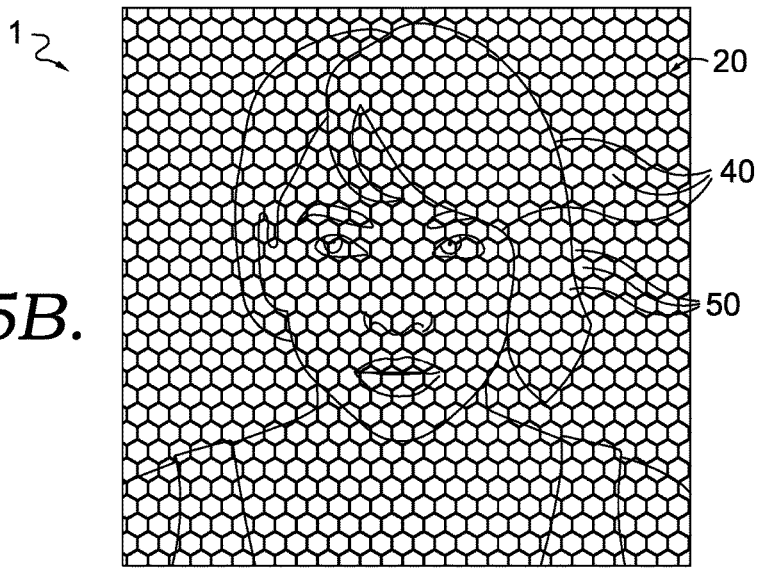
FIG. 5B is a top elevation view of an embodiment of the pixel canvas art apparatus, in accordance with an embodiment of the present invention.

Certain embodiments of the pixel canvas art apparatus may be configured to create multiple pixel canvas artworks and as such, may include a universal pixel canvas. In other embodiments, the pixel canvas art apparatus may be configured to create a customizable pixel canvas artwork. In FIG. 5A, a universal pixel canvas is illustrated and in FIG. 5B, a customizable pixel canvas is shown. As shown in FIG. 5A, the universal pixel canvas includes a similar configuration as FIG. 1A but for a different shape and size and includes the same components. FIG. 5B also includes the same components as FIG. 1A, but the interconnected partitions 40 may be positioned throughout the receiving layer 20 in a non-uniform manner or in a manner that best suits a particular pixelated image or a pixel canvas artwork. The interconnected partitions 40 may be configured to form certain elements of the pixel canvas artwork, which may not be suitably defined by a uniform pattern of the interconnected partitions 40. As such, the interconnected partitions 40 may be positioned within the receiving layer 20 such that the interconnected partitions 40 may form a continuous outline of an object of the pixel canvas artwork and may be similarly positioned to form other elements of the pixel canvas artwork. For example, the interconnected partitions 40 may be positioned in a manner in which one interconnected partition forms a continuous outline of a face while other interconnected partitions form elements of an eye or a nose. In further aspects, the pixel canvas art apparatus may also include the interconnected partitions 40 as shown in FIGS. 1A and 5A. Accordingly, some elements of the pixel canvas artwork may be formed by the interconnected partitions 40 positioned in a non-uniform manner and other elements of the pixel canvas artwork may be formed by the interconnected partitions 40 positioned in a manner that provides a tessellating pattern of uniform, repeating shapes aligned in rows and columns throughout the receiving layer 20.

Figure 6A:
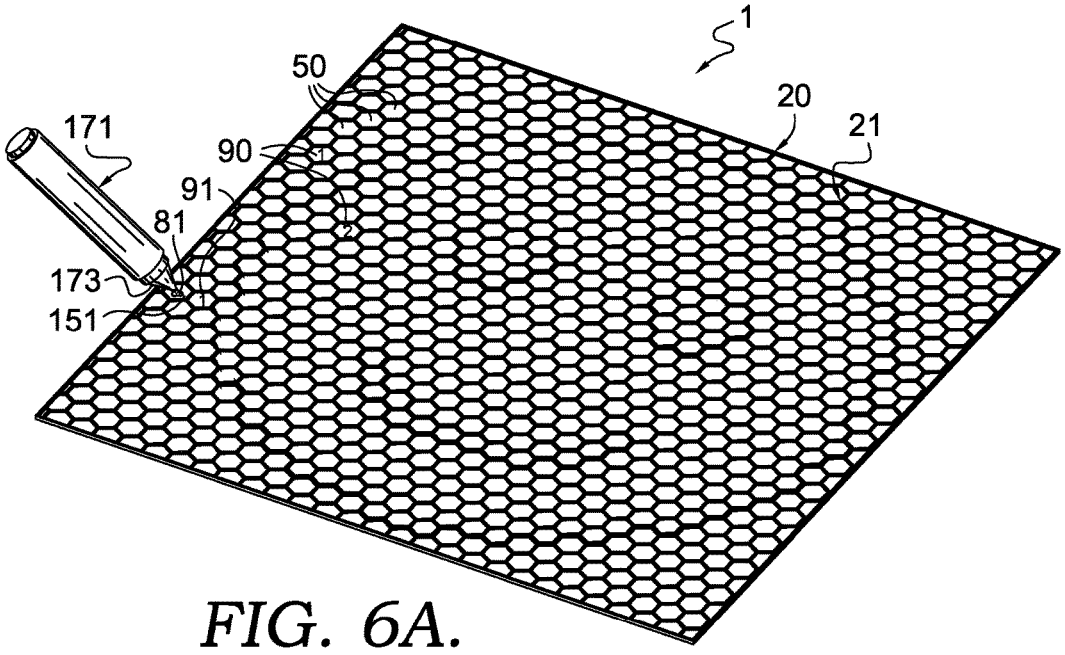
FIG. 6A is a perspective view of the pixel canvas art apparatus of FIG. 1A receiving a first water-based marking from a first marking device, in accordance with an embodiment of the present invention.
Figure 6B:
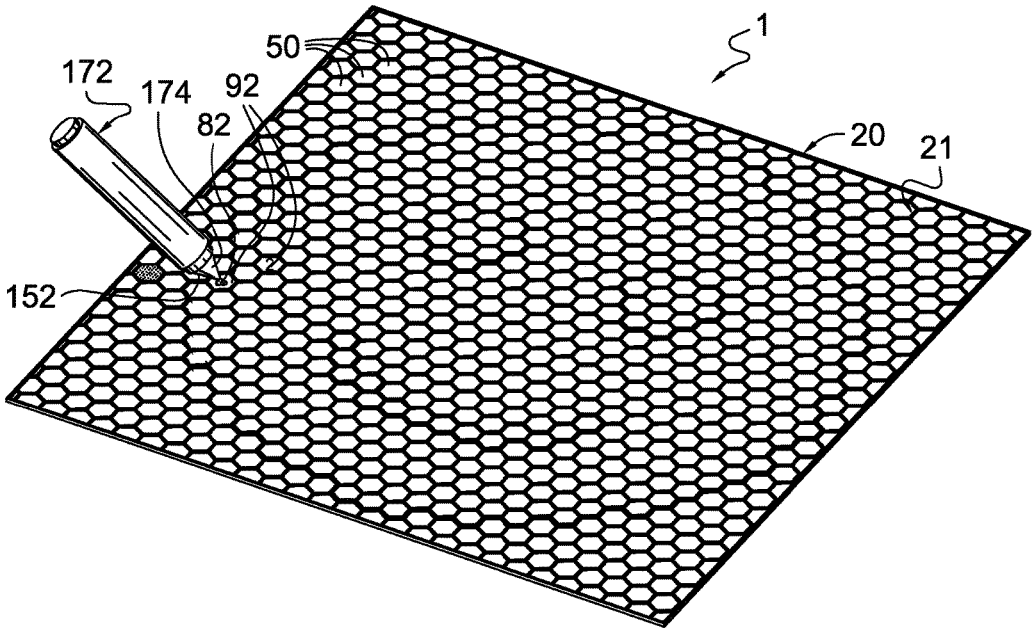
FIG. 6B is a perspective view of the pixel canvas art apparatus of FIG. 1A receiving a second water-based marking from a second marking device, in accordance with an embodiment of the present invention.
Figure 6C:
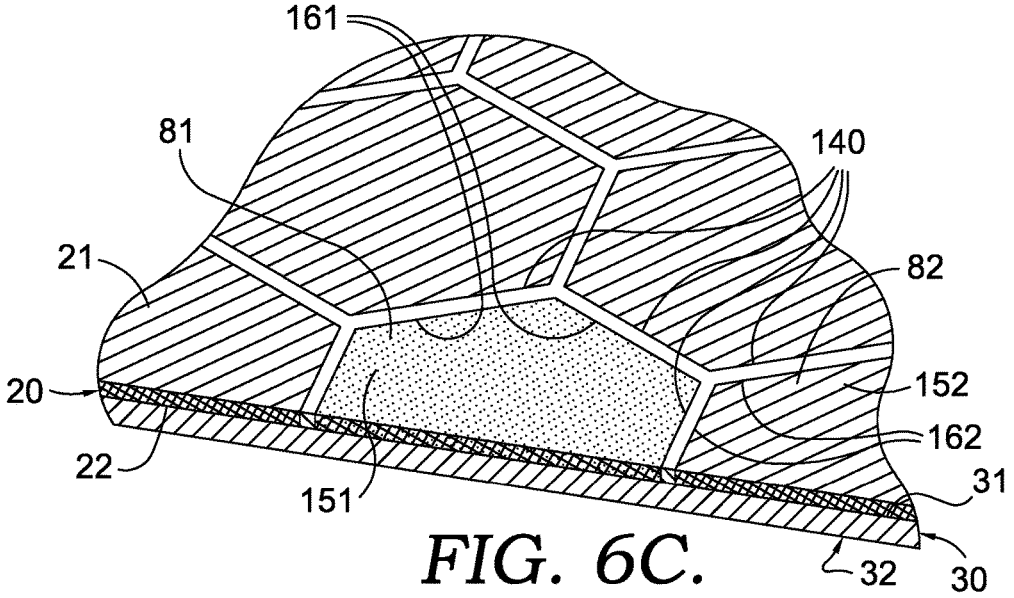
FIG. 6C depicts an enlarged, fragmentary, perspective view of the pixel canvas art apparatus of FIG. 1A after receiving one or more water-based markings and with a portion removed, illustrating absorption of one or more water-based markings at an interior portion of the receiving layer, in accordance with an embodiment of the present invention.

In other embodiments, the pixel canvas art apparatus may be configured to receive one or more water-based markings from one or more marking devices to create the pixel canvas artwork. These embodiments may include employing components described herein and may further include instructions that may direct receipt of the one or more water-based markings to a specific segmented component based on a location of the specific segmented component. An example of such an embodiment is illustrated in FIGS. 6A-6C. As shown, the segmented components 50 of the pixel canvas art apparatus 1 may comprise a plurality of position values 90 that may be based on a location of the segmented components 50. Moreover, the position values 90 may be represented by a number or symbol and may be placed on or over the segmented components 50 on the first surface 21 to provide visual indications that may associate the segmented components 50 with a respective position value. In more aspects, the position values 90 may also be associated with one or more marking devices such that one position value may correspond to one marking device, which may be indicated to a user by a first instruction. Moreover, the first instruction may further direct the user to apply the one or marking device to the segmented components 50 based on the plurality of position values 90. Thus, a water-based marking included in the one or more marking devices may be transferred to the segmented components 50 and absorbed by the receiving layer 20 included therein. Further, after applying the one or more marking devices to in a manner directed by the first instruction, one or more water-based markings may be absorbed by the receiving layer 20, which collectively may form a pixel canvas artwork. These aspects, as well as other, are exemplified in FIGS. 6A-6C, which illustrate the pixel canvas art apparatus 1 receiving one or more water-based markings that may form the pixel canvas artwork shown in FIG. 7.

In exemplary aspects and with reference to FIG. 6A, a first segmented component 151 may include a first position value 91 that may be indicated by marking a "1" on the first surface 21 of the receiving layer 20 included within the first segmented component 151. Additionally, the first position value 91 may be associated with a first marking device 171 including a first application tip 173 and a first-water based marking 81, which may be a first color. Thus, upon positioning the first application tip 173 on the first surface 21 of the receiving layer 20 at the first position value 91 associated with the first segmented component 151, the first water-based marking 81 may be transferred from the first marking device 171 to the receiving layer 20. The first water-based marking 81 may then be absorbed by the receiving layer 20 at the first segmented component 151, and the first color of the first-water based marking 81 may then be imparted on a portion of the receiving layer 20 defined by the first segmented component 151.

Referring now to FIG. 6B, a second segmented component 152 may include a second position value 92 that may be indicated by marking a "2" on the first surface 21 of the receiving layer 20 included within the second segmented component 152. Additionally, the second position value 92 may be associated with a second marking device 172 including a second application tip 174 and a second-water based marking 82, which may be a second color. Thus, upon positioning the second application tip 174 on the first surface 21 of the receiving layer 20 at the second position value 92 associated with the second segmented component 152, the second water-based marking 82 may be transferred from the second marking device 172 to the receiving layer 20. The second water-based marking 82 may then be absorbed by the receiving layer 20 at the second segmented component 142, and the second color of the second water-based marking 82 may then be imparted on a portion of the receiving layer 20 defined by the second segmented component 152.

With reference now to FIG. 6C, after application of the first and second marking devices 171, 172 in a manner such that contact between the respective application tips 173, 174 and the first surface 21 may be maintained for a sufficient duration, the first and second water-based markings 81, 82 may be generally absorbed by the receiving layer 20. Thus, the first and second water-based markings 81, 82 may be entirely dispersed throughout the first surface 21, throughout the second surface 22, and within the interior body 25. Further, a first border 161 formed by at least two or more interconnected partitions 140 may enclose the first water-based marking 81 within the first segmented component 151, preventing transfer and further absorption of the first-water based 81 marking throughout the receiving layer 20, and likewise, a second border 162 formed by at least two or more interconnected partitions 31 may enclose the second water-based marking 82 within the second segmented component 152, preventing transfer and further absorption of the second water-based marking throughout the receiving layer 20. Accordingly, as the first and second water-based markings 81, 82 are absorbed by the receiving layer 20 and respectively enclosed in the first and second segmented components 151, 152, the first color may be imparted on the receiving layer 20 at the first segmented component 151 and the second color may be imparted on the receiving layer 20 at the second segmented component 152.

In additional aspects, the second surface 22 may comprise a coating that may prevent absorption of the first and second water-based markings 81, 82, and thus, the first and second water-based markings 81, 82 may be absorbed in the receiving layer 20 throughout the first surface 21 and interior body 25 but may not be absorbed at the second surface 22. Thus, the second surface 22 may act as an additional fluid barrier like the first and second borders 161, 162 and may also prevent the first and second water-based markings 81, 82 from transferring or exiting the receiving layer 20 at the second surface 22.

Although not shown, each remaining segmented component in the plurality of segmented components 50 may also have a corresponding position value included in the plurality of position values 90, which may be associated with one marking device of the one or more marking devices. Moreover, each remaining segmented component may receive and absorb a water-based marking in a manner like that of the first segmented component 151 and the second segmented component 152. In exemplary aspects, prior to receiving a water-based marking the receiving layer 20 of the pixel canvas art apparatus 1 may be in an a first state or an un-treated state, as shown in FIGS. 1A, 5A, and 5B, and after receiving a water-based marking, receiving layer 20 may be in a second state or a treated state as shown in FIGS. 4A, 4B, 6A-6C, and 7.

Figure 7:
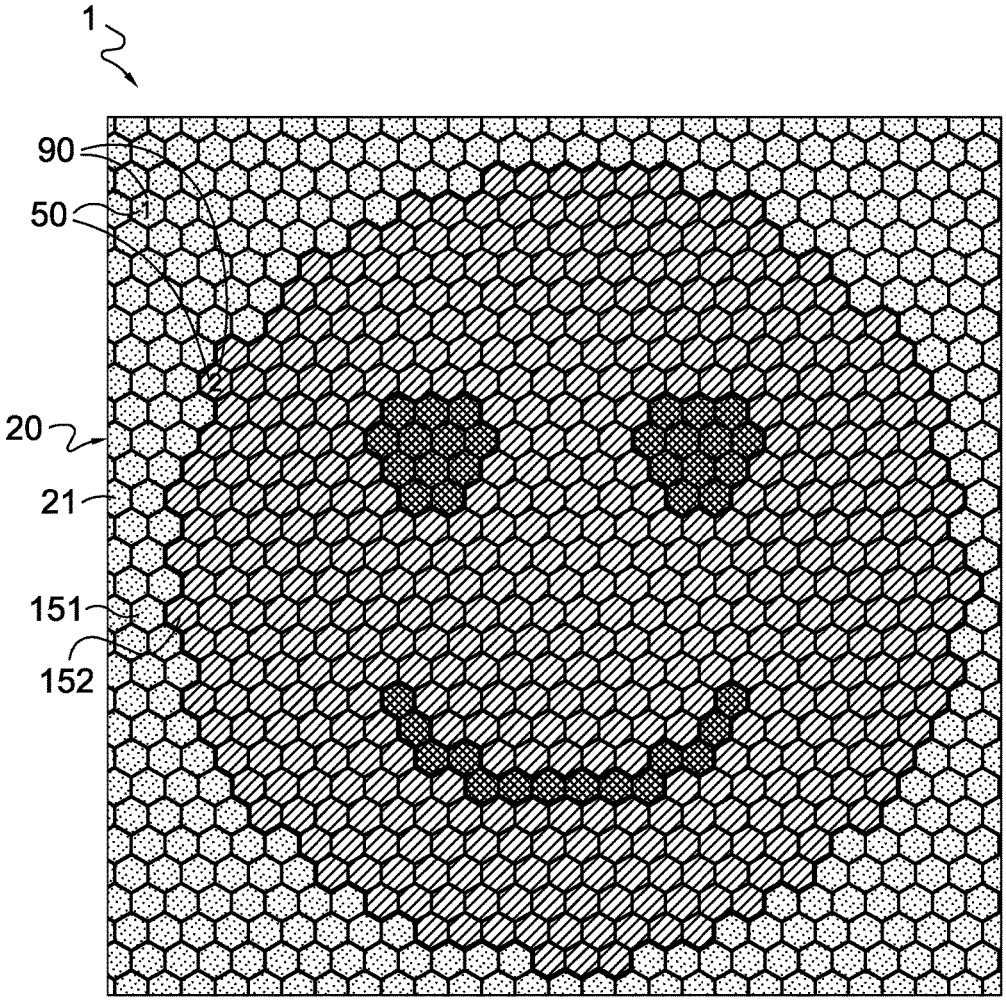
FIG. 7 is a top elevation view of the pixel canvas art apparatus of FIG. 1A after receiving one or more water-based markings to create a pixel canvas artwork, in accordance with an embodiment of the present invention.

In FIG. 7, the receiving layer 20 is shown in a treated state. As such, the pixel canvas artwork may be created after repeated application of the one or more marking devices to the first surface 21 of the receiving layer 20 at the position values 90 associated with the segmented components 50, the one or more water-based markings may impart one or more colors onto the receiving layer 20. Collectively, these segmented components define the pixel canvas artwork. As discussed, the first instruction may indicate to the user an association between the position values 90 and the one or more marking devices, and further, may direct the user to apply a marking device to one or more segmented components based on the one position value of the one or more segmented components. As a result, the first instruction may be configured to create the pixel canvas artwork. In further aspects, a second instruction may be configured to create a pixel canvas artwork that differs from the pixel canvas artwork created by the first instruction. Therefore, the second instruction may include different associations between the plurality of position values and the one or more marking devices and may also direct the user to apply the one or more water-based markings in a different manner than the first instruction.

In other aspects, the pixel canvas art apparatus 1 may be configured to be reusable and may allow for creation of multiple pixel canvas artworks. Such aspects may include using a washable material to construct the receiving layer 20 and may also include forming the interconnected partitions 40 from a durable, wash-resistant material. Moreover, the water-based marking 80 may include a non-permanent ink solution that may be removed or washed from the receiving layer 20.

Figure 8:
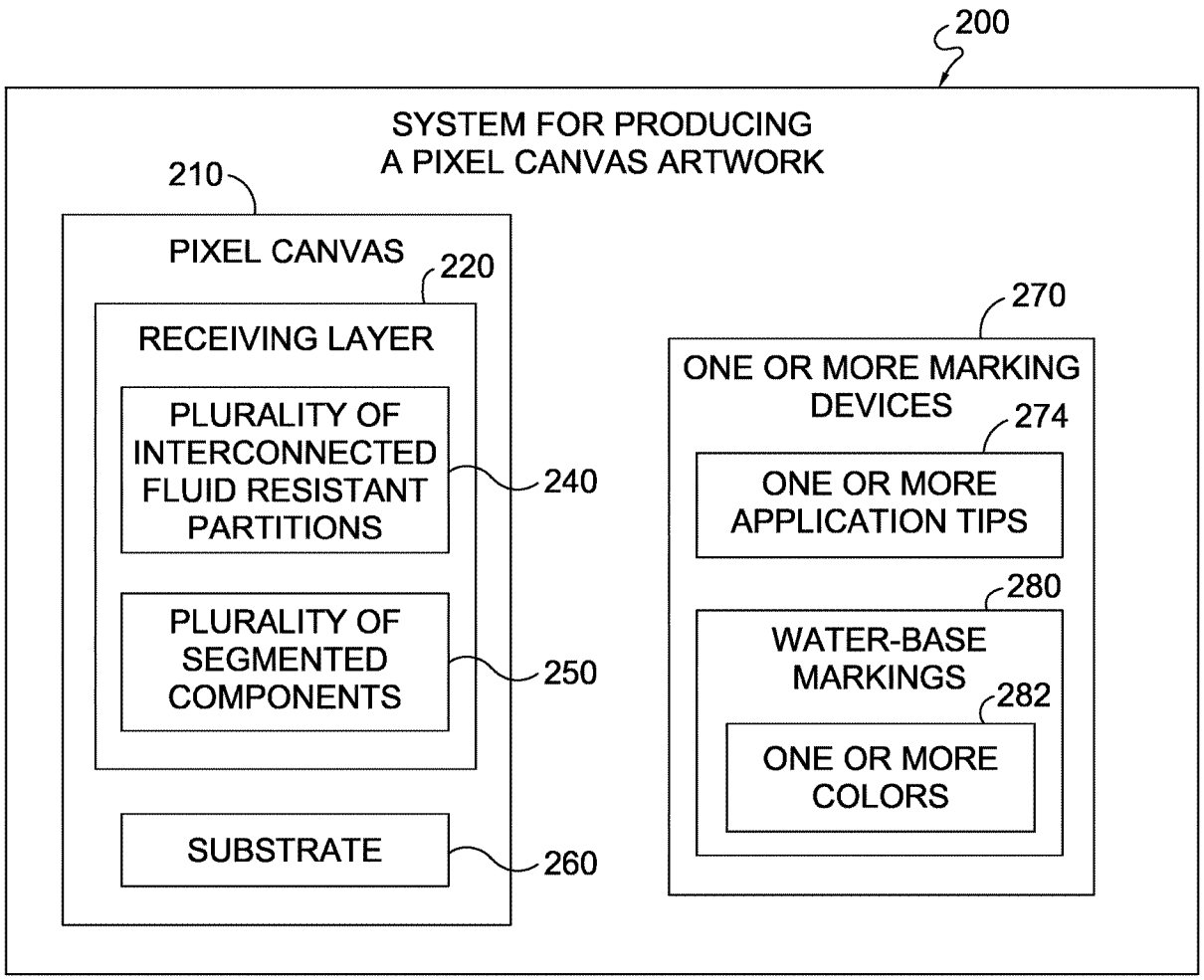
FIG. 8 is a diagram of the components of a system for producing a pixelated canvas artwork, in accordance with an embodiment of the present invention.

Embodiments of the invention also include a system for producing a pixel canvas artwork. In the illustrative embodiment of FIG. 8, exemplary components of a system 200 for producing pixel canvas artwork are provided. As shown, the pixel canvas art system 200 may include a pixel canvas 210, one or more marking devices 270, and one or more water-based markings 280. Embodiments of the pixel canvas system 200 may include any combination of these components, and any combination of the respective aspects and features of these components. In some embodiments the pixel canvas 210 may comprise a receiving layer 220, a substrate 230, a plurality of interconnected fluid-resistant partitions 240, and a plurality of segmented components 250. Further and in some aspects, the receiving layer 220 may include a first surface and a second surface and may be configured to absorb the one or more water-based markings 280, the fluid-resistant partitions 240 may be positioned throughout the substrate and may be configured to prohibit transfer of the one or more water-based markings 280 absorbed by the receiving layer 220, and the segmented components 250 may be adjacently arranged within the receiving layer 220 and may be defined by at least two or more interconnected fluid-resistant partitions. Additionally, the segmented components 250 may be configured such that the one or more water-based markings 280 absorbed by the receiving layer 220 at one of the segmented components within the receiving layer 220 may be enclosed by the one segmented component and may be prohibited from transferring throughout the receiving layer 220 to each other segmented component of the segmented components 250 within the receiving layer 220.

In other aspects, the one or more marking devices 270 may be configured to transfer the water-based marking 280 to the pixel canvas 210 upon contact with the first surface of the receiving layer, and further each marking device of the one or more marking devices 270 may comprise an application tip 274 configured to transfer the water-based marking 280 to the pixel canvas 210 upon contact with the first surface of the receiving layer 220. In certain aspects, the water-based marking 280 transferred to the pixel canvas 210 may comprise one or more colors 282, and each marking device of the one or more marking devices 270 may be associated with one of the one or more colors 282.

In additional embodiments, the invention includes a method or process for creating a pixel canvas artwork. The method may include a universal pixel canvas and a first water-based marking may be received by the universal pixel canvas by positioning a first application tip of a first marking device on the first surface of the universal pixel canvas at a first position value associated with a first pixel component. After receipt of the first water-based marking, a second water-based marking may be received. In a similar manner as the first water-based marking, the second water-based marking may be received on the first surface of the universal pixel canvas in response to positioning a second application tip of a second marking device on the first surface of the universal pixel canvas at a second position value associated with a second pixel component. Once the second water-based marking is received, a pixel canvas artwork may be created.

In more aspects, the first water based marking may comprise a first color, and the second-water based marking may comprise a second color. Further, the first color and the second color may be a same color or may be a different color. Additionally, the method for creating a pixel canvas artwork may include a first instruction that may be configured to direct receipt of the first water-based marking to a first set of one or more position values on the first surface of the universal pixel canvas. The first instruction may also be configured to direct receipt of the second water-based marking to a second set of one or more position values on the first surface of the universal pixel canvas. Moreover, receipt of the first water-based marking and the second water-based marking at the first surface of the universal pixel canvas as directed by the first instruction may create a first pixelated image. In even further aspects, a second set of instructions may be configured to direct the receipt of the first water-based marking and the second water-based marking at one or more position values to create a second pixelated image.

Figure 9A:
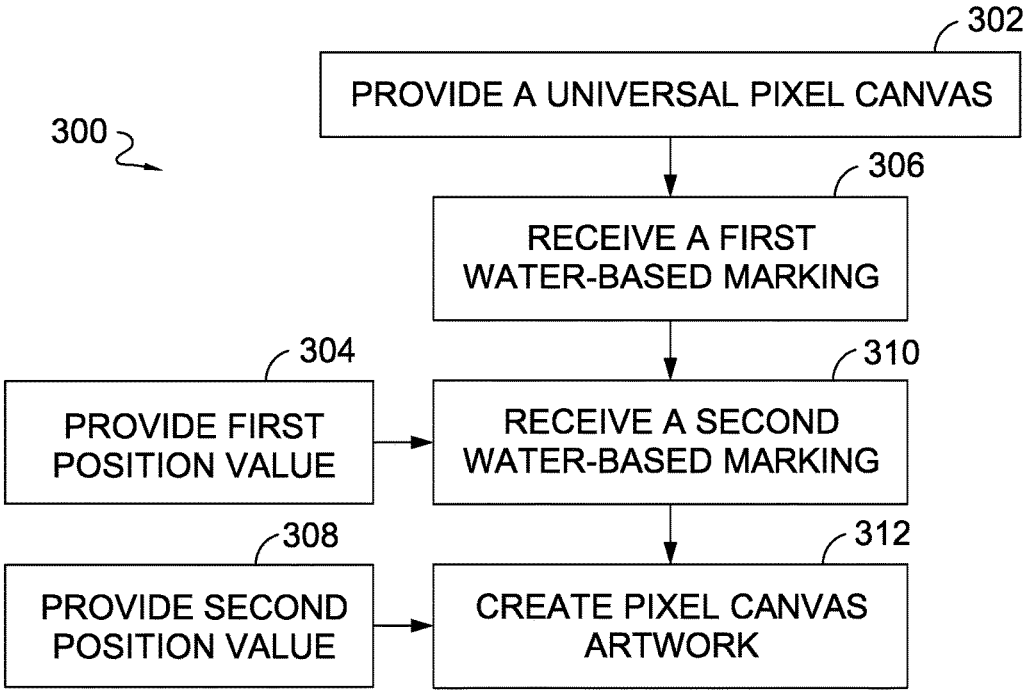
FIG. 9A is a flow diagram of a method for creating a pixel canvas artwork, in accordance with an embodiment of the invention.
Figure 9B:
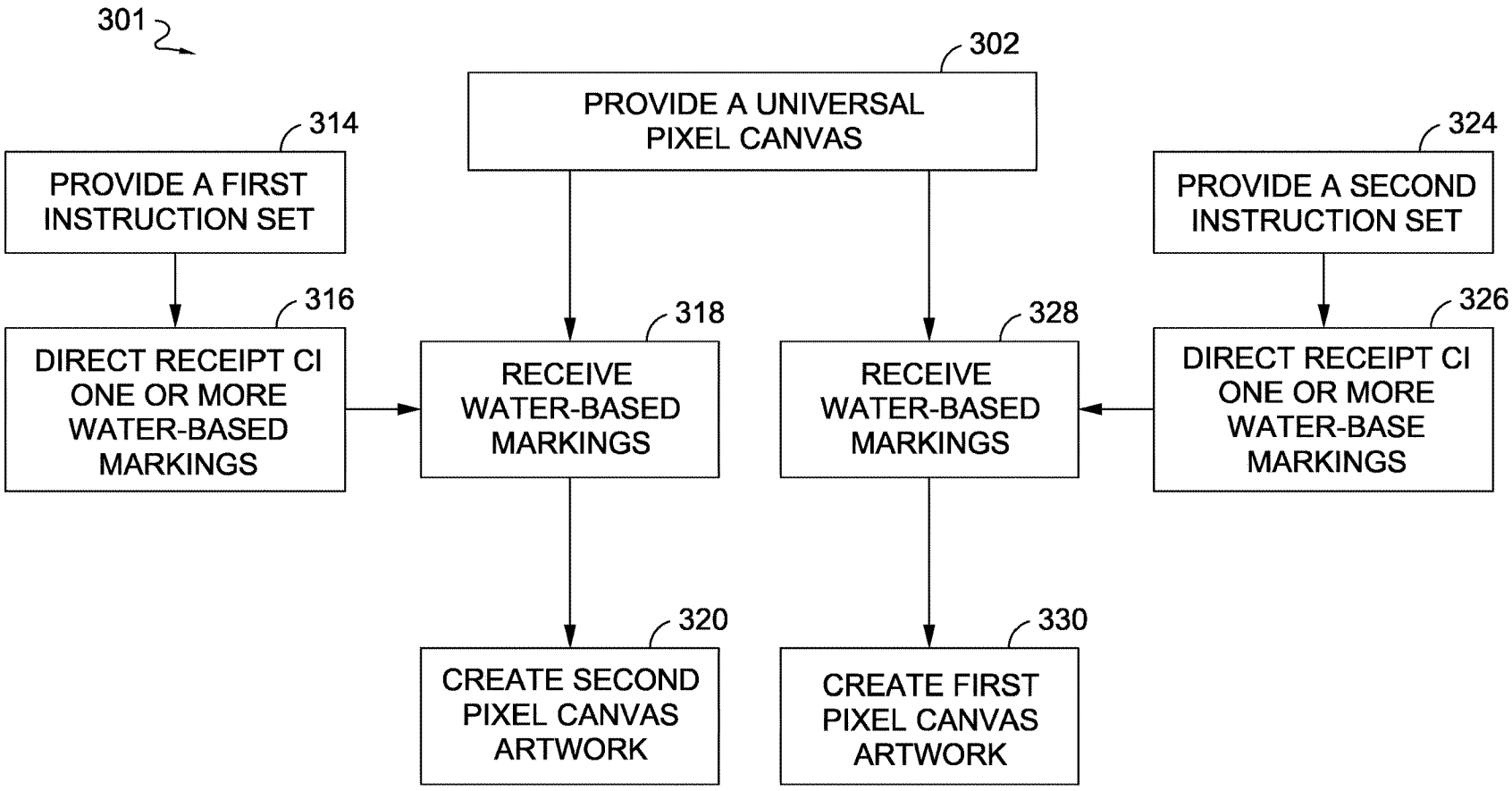
FIG. 9B is a flow diagram of a method for creating a pixel canvas artwork, in accordance with an embodiment of the invention.

Illustrative embodiments of steps included in a method for creating a pixel canvas artwork 300, 301 are shown in FIGS. 9A and 9B. As depicted in FIG. 9A, an exemplary method for creating pixel canvas artwork 300 may include the following steps. A universal pixel canvas may be provided 302, which may receive a first water-based marking 306 and a second water-based marking 310. In some aspects, the first water-based marking may be received on the first surface of the universal pixel canvas based on a provided first position value 304 and the second-water based marking may be received on the first surface of the universal pixel canvas based on a provided second position value 308. These steps may be repeated to create a pixel canvas artwork 312.

In FIG. 9B, an exemplary method for creating a pixel canvas artwork 301 may include instructions and involve the following steps. A universal pixel canvas and a first instruction may be provided 302, 314. The first instruction set 314 may direct receipt of one or more water-based markings 316, and the one or more water based marking are received by the universal pixel canvas 318 to create a first pixel canvas artwork 320. This method may further include providing a second instruction set 324. As such, the second instruction set may direct receipt of one or more water-based markings 330, and the one or more water based marking are received by the universal pixel canvas 328 to create a second pixel canvas artwork 330.

Some embodiments of the pixel canvas art system 200 and the method for creating a pixel canvas artwork 300 may employ components provided by the pixel canvas art apparatus 10 as described herein. Thus, embodiments of the pixel canvas art system 200 and the method for creating a pixel canvas artwork 300 may include the receiving layer 20, the plurality of interconnected partitions 40, and the plurality of segmented components 50. Accordingly, the receiving layer 20 and aspects thereof may be interchangeable with the universal pixel canvas, and the plurality of segmented components 50 and aspects thereof may also be interchangeable with the plurality of adjacently arranged pixel components. In addition, embodiments may also include similar components that may correspond to and include aspects of components of the pixel canvas art apparatus 10 that are depicted in FIGS. 6A-6C, which may include the first and second segmented components 151, 152, the first and second marking devices 171, 172, and the first and second water-based markings 81, 82.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A pixel canvas art apparatus comprising:

a receiving layer comprising a first surface, a second surface, and an interior receiving body between the first surface and the second surface, wherein the first surface and the second surface are mutually opposed;

a substrate layer comprising a third surface, a fourth surface, and an interior substrate body, wherein the third surface and the fourth surface are mutually opposed, said second surface of the receiving layer adjacent said third surface of the substrate layer;

a plurality of interconnected partitions positioned throughout the receiving layer, each interconnected partition of the plurality of interconnected partitions traverses the interior receiving body from the first surface to the second surface, wherein the plurality of interconnected partitions form at least one liquid barrier in the receiving layer, and wherein the plurality of interconnected partitions comprise a fluid-resistant material, and further wherein the fluid-resistant material comprises a blocking ink that is printed on the receiving layer; and a plurality of segmented components adjacently arranged within the receiving layer, each segmented component of the plurality of segmented components surrounded by the plurality of interconnected partitions.

2. The pixel canvas art apparatus of claim 1, wherein the receiving layer comprises a fabric configured to wick a water-based marking via the first surface.

3. The pixel canvas art apparatus of claim 1, wherein the receiving layer and the substrate layer are joined together to form a pixel canvas artwork defined by the plurality of interconnected partitions, and wherein the border of each segmented component of the plurality of segmented components forms a portion of the pixel canvas artwork.

4. The pixel canvas art apparatus of claim 2, wherein the water-based marking is absorbed by the receiving layer and wherein the plurality of interconnected partitions are configured to enclose each water-based marking within the border of each of the segmented components of the plurality of segmented components.

5. The pixel canvas art apparatus of claim 1, wherein the blocking ink further comprises resins configured to crosslink upon curing with ultraviolet light.

6. The pixel canvas art apparatus of claim 1, wherein a border of each of the segmented components is formed by two or more interconnected partitions that are linearly positioned throughout the receiving layer, and wherein the border of each of the segmented components defines a shape with two or more linear sides.

7. The pixel canvas art apparatus of claim 1, wherein the plurality of segmented components comprises a uniform arrangement within the receiving layer, said uniform arrangement comprising one or more of:

multiple rows of segmented components positioned at a consistent spacing along a first axis of the receiving layer; and multiple columns of segmented components positioned at a consistent spacing along a second axis of the receiving layer.

8. A system for producing a pixel canvas artwork, the system comprising:

a pixel canvas comprising:

(1) a receiving layer comprising a first planar surface parallel to a second planar surface, the receiving layer configured to absorb at least one water-based marking;

(2) a plurality of interconnected fluid-resistant partitions positioned throughout the receiving layer and configured to retain the at least one water-based marking absorbed by the receiving layer; and (3) a plurality of segmented components adjacently arranged within the receiving layer and defined by at least two or more interconnected fluid-resistant partitions of the plurality of interconnected fluid-resistant partitions, wherein the plurality of segmented components are configured such that the at least one water-based marking absorbed by the receiving layer is retained proximate a segmented component of the plurality of segmented components based on a surrounding portion of the plurality of interconnected fluid-resistant partitions and a point of contact of the at least one water-based marking with the first planar surface, and one or more marking devices configured to transfer the at least one water-based marking to the pixel canvas upon contact with the first planar surface of the receiving layer.

9. The system of claim 8, further comprising a substrate layer coupled to the pixel canvas, said substrate layer positioned adjacent the second planar surface of the receiving layer.

10. The system of claim 8, wherein the plurality of interconnected fluid-resistant partitions comprises a hardened ink cured with ultraviolet light.

11. A method for creating a pixel canvas artwork, the method comprising:

receiving, by a first surface of a universal pixel canvas, a first water-based marking, wherein the universal pixel canvas comprises a plurality of adjacently arranged pixel components, each pixel component having a position value based on a location of the pixel component within the plurality of adjacently arranged pixel components, said first water-based marking received in response to a first application tip of a first marking device positioned on the first surface of the universal pixel canvas at a first pixel component associated with a first position value;

receiving, by the first surface of the universal pixel canvas, a second water-based marking, said second water-based marking received in response to a second marking device positioned on the first surface of the universal pixel canvas at a second pixel component associated with a second position value, wherein the universal pixel canvas comprises a fluid-resistant boundary between two or more pixel components adjacently positioned within the plurality of the adjacently arranged pixel components, said fluid-resistant boundary configured to retain the first water-based marking within the first pixel component and retain the second water-based marking within the second pixel component.

12. The method of claim 11, wherein the fluid-resistant boundary comprises an ink hardened upon curing with ultraviolet light.

13. The method of claim 11, wherein the first water-based marking comprises a first color and the second water-based marking comprises a second color different than the first color.

14. The method of claim 11, wherein retaining the first water-based marking within the first pixel and retaining the second water-based marking within the second pixel comprises transferring the received first water-based marking from the first surface of the universal pixel canvas towards a second surface of the universal pixel canvas.

15. The method of claim 11 further comprising associating a first instruction with the universal pixel canvas, said first instruction comprising a plurality of pixel color indicators associated with each of the plurality of adjacently arranged pixel components, wherein the first instruction is configured to direct receipt of the first water-based marking to a first set of one or more position values on the first surface of the universal pixel canvas, and wherein the first instruction is further configured to direct receipt of the second water-based marking to a second set of one or more position values on the first surface of the universal pixel canvas to create a first pixel canvas artwork according to a pattern of the first instruction.

16. The method of claim 15 further comprising a second instruction comprising a plurality of pixel color indicators associated with each of the plurality of adjacently arranged pixel components, wherein the second instruction is configured to direct receipt of a third water-based marking to a third set of one or more position values on the first surface of the universal pixel canvas, and wherein the second instruction is further configured to direct receipt of the fourth water-based marking to a fourth set of one or more position values on the first surface of the universal pixel canvas to create a second pixel canvas artwork according to a pattern of the second instruction.

17. The method of claim 11, wherein each pixel component of the plurality of adjacently arranged pixel components is surrounded on all sides by the fluid-resistant boundary, said fluid-resistant boundary providing a repeated geometric pattern associated with the plurality of adjacently arranged pixel components and the plurality of pixel color indicators.

* * * * *